United States Patent [19]

Kreuger

[11] 3,931,779

[45] Jan. 13, 1976

[54] SAILING BOAT

[76] Inventor: Sten Kreuger, Chateau de Malvande, Chambesy-Geneva, Switzerland

[22] Filed: May 1, 1972

[21] Appl. No.: 249,154

[30] Foreign Application Priority Data

| | | |
|---|---|---|
| Apr. 30, 1971 | Switzerland | 6382/71 |
| Mar. 8, 1972 | Switzerland | 3434/72 |

[52] U.S. Cl. ..... 114/39; 114/162

[51] Int. Cl.[2] ..... B63H 9/00

[58] Field of Search ... 114/39, 102, 97, 98, 162–164, 114/123

[56] References Cited

UNITED STATES PATENTS

| | | | |
|---|---|---|---|
| 1,348,912 | 8/1920 | Ward | 114/39 |
| 1,846,458 | 2/1932 | Robinson | 114/39 |
| 3,259,093 | 7/1966 | Taylor | 114/39 |
| 3,793,973 | 2/1974 | Patterson | 114/39 |

*Primary Examiner*—Duane A. Reger
*Assistant Examiner*—Stuart M. Goldstein
*Attorney, Agent, or Firm*—Louis Allahut; Arthur Schwartz; Raymond A. Robic

[57] ABSTRACT

A boat having a mainsail and a conventional rudder. The mainsail is supported by a mast and a pivotally mounted boom. A blade is pivotally mounted toward the free end of the boom about an axis that is substantially parallel to the mast. The blade acts as an auxiliary rudder for steering the boom and setting the angle of the sail. Though the boom pivots, the blade may be held parallel to a pre-set direction, so that the leeway component of the force of the wind on the sail is held substantially constant.

8 Claims, 3 Drawing Figures

$\vec{P_2}$
$\vec{F_2}$
$\vec{F_1}$
$\vec{P_1}$
$\vec{D_2}$
$\vec{D_1}$
E
35
38
36

SAILING BOAT

The invention relates to sailing boats, and is more particularly concerned with sailing boats having a mainsail supported by a mast and a pivotally mounted boom.

Sailing "close hauled" against the wind is a maneuver requiring a great deal of skill, since the mainsail must be trimmed to an angle with the wind to obtain the maximum driving force, whilst the leeway force must be balanced, as far as possible, by the crew leaning overboard in order to try and keep the boat on an even keel.

It is an aim of the invention to provide a sailing boat in which the operation of setting or trimming the mainsail when sailing close hauled can be carried out rapidly and simply.

According to the invention, a sailing boat comprises a mainsail supported by a mast and a pivotally mounted boom, a blade pivotally mounted on the boom towards the free end thereof about an axis substantially parallel to the mast, said blade being able to protrude downwardly below the waterline of the boat at least when the boat has a certain list so as to form a rudder for steering the boom, and means for setting the angular position of the blade about said axis.

When sailing, the blade dips into the water and acts as a rudder steering the boom, so that by setting the angular position of the blade it is possible to set the boom and therefore the mainsail at a desired angle.

The boat advantageously comprises means acting on the angular position of the blade to steer the boom under variations of the wind to keep the leeway component of the force of the wind on the mainsail at a pre-set substantially constant value.

By this means, changes in the wind are counteracted by movement of the mainsail and the boat holds the same list without displacement of the crew, whereas in conventional boats in which rapid adjustment of the mainsail is difficult such changes in the wind cause rolling which can only be counteracted by displacement of the crew. Resilient means are preferably provided for acting on the blade to tend to hold the blade in alignment with the boom.

One embodiment of the invention will now be described, by way of example, with reference to the accompanying schematic drawings, in which.

Figure 1:
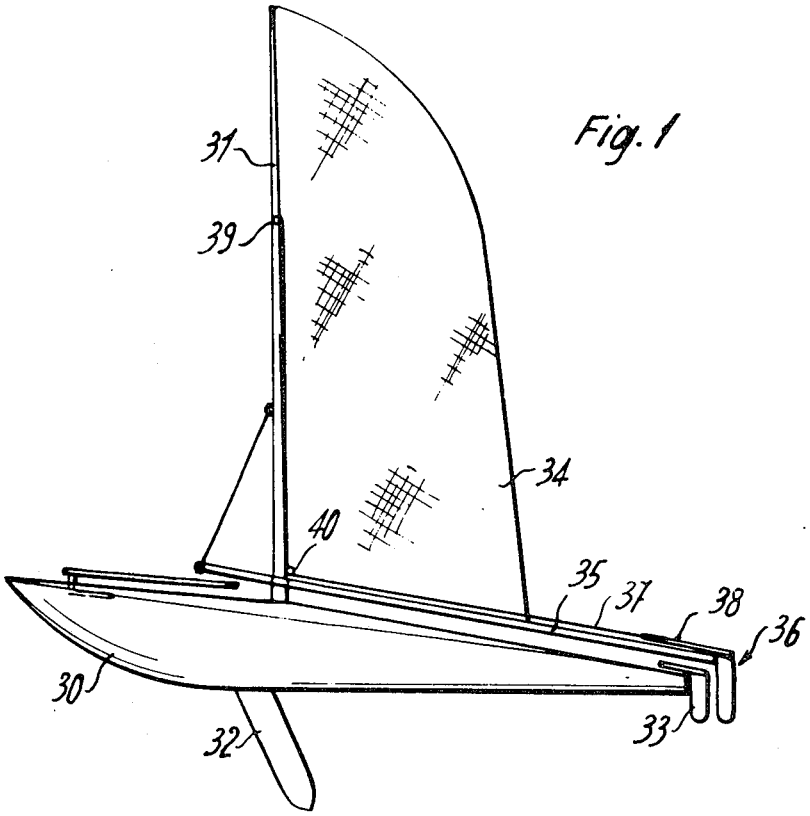
FIG. 1 is a side elevation of a drop-keel sailing boat.
Figure 2:
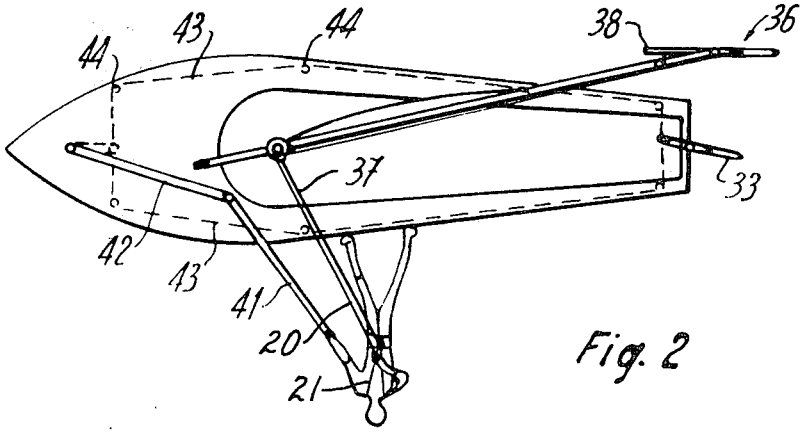
FIG. 2 is a plan view of the boat of FIG. 1 during close hauled sailing.

The drop-keel boat shown in FIGS. 1 and 2 comprises a hull 30, a mast 31 mounted substantially perpendicular to the direction of elongation of the hull 30 in the median longitudinal plane of symmetry thereof, a conventional adjustable keel 32 under the hull 30, and a rudder 33 pivotally mounted at the stern of hull 30.

A boom 35 is pivotally mounted about the base of mast 31 with a mainsail 34 supported in conventional manner by the mast 31 and boom 35, the boom being attached to and extending the foot of the mainsail. The boom 35 extends from the mast 31 to a free end protruding beyond the stern and a blade 36 is pivotally mounted at this free end about an axis substantially parallel to the mast. The blade 36 protrudes downwardly below the waterline of the boat so as to form a rudder for steering the boom 35.

Control of the main rudder 33 is ensured, when the helmsman is suspended in a trapeze 20 and harness 21 as shown in FIG. 2, by means of a control rod 41 interconnected with a bar 42 and two cords 43 passing about a system of pulleys 44.

Control of the angular position of the auxiliary rudder blade 36 is effected by means of a flexible cable 37 secured at one end to a tiller 38 fixed to the rudder blade 36. The cable 37 is threadably secured to the mast 31 adjacent to the point of fixture of the trapeze cable having means for securing a harness at its other end. The trapeze also includes means for adjustably securing the free end of the cable 37 in selected positions relative to the harness, so that the angle of the rudder blade 36 may be set relative to the boom 35.

In one form, the cable 37 is substantially non-extensible, so that setting of the rudder blade 36 relative to the boom 35 is carried out at will, and can be modified depending upon the conditions to set the boom 35 and the mainsail 34 at a desired angle to the wind.

In another form, explained in connection with FIG. 3, the cable 37 has an elastically extensible portion E. The characteristics of this portion are selected as a function, inter alia, of the dimensions and dispositions of the blade 36 and mainsail (not shown) such that upon variation of the wind the boom is steered to keep the leeway component of the force of the wind on the mainsail at a pre-set substantially constant value.

Figure 3:
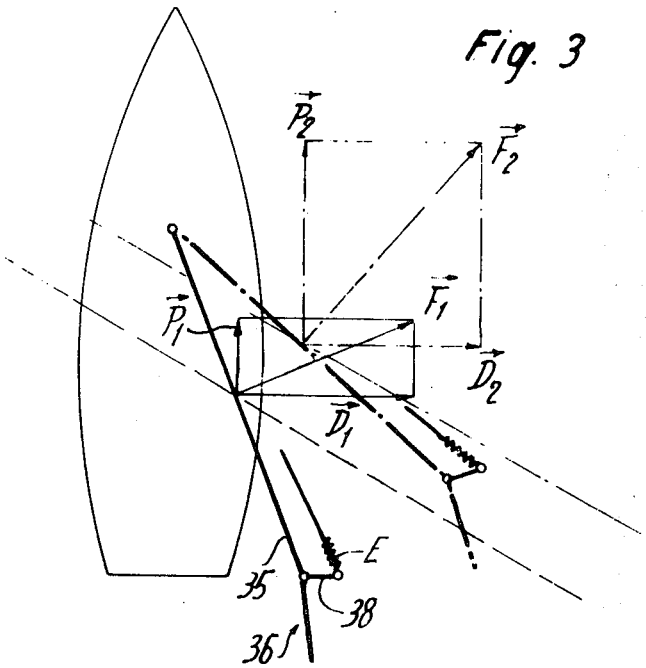
FIG. 3 is an explicative diagram.

The explanatory diagram of FIG. 3 shows a displacement of the boom 35 and the mainsail upon an increase in the force of the wind, this displacement being greatly exaggerated for the purposes of explanation. The apparent direction of the wind, which is supposed to remain unchanged, is indicated in broken lines. In the first position, the useful component $F_1$ of the wind acting on the effective centre of the mainsail produces a driving force $P_1$ and a leeway force $D_1$. The effect of the leeway force $D_1$ tending to make the boom 35 pivot about the mast 31 is counterbalanced by the resistance of water against the rudder blade 36 whilst the effect of the leeway force $D_1$ tending to make the boat list is counterbalanced by the helmsman placing his weight to keep the boat on an even keel. When the force of the wind increases, for example, the mainsail and boom 35 are displaced to a second equilibrium position in which the useful component $F_2$ of the wind produces a driving force $P_2$ and a leeway force $D_2$. This is accompanied by an elongation of the elastic portion E of cable 37 apt to keep $D_2$ substantially equal to $D_1$ which is equivalent, for an unchanged speed of the boat, to holding the rudder blade 36 in a substantially constant alignment relative to the boat. Consequently, the boat does not tend to list, but keeps on an even keel without need for the helmsman to displace his weight.

Various modifications may be made to the described embodiments. In particular, the device acting on the sail-steering rudder blade could rely on other means than an elastically extensible section of a cable. This means for setting the angular position of the rudder blade could also act on the afterpiece thereof.

What I claim is:

1. A boat comprising:

a. a hull having a direction of elongation and a waterline, b. a mast mounted on said hull, c. a boom pivotally mounted on said mast, d. a mainsail supported by said mast and said boom, said boom attached to and extending the foot of the mainsail, e. a blade mounted on the free end of said boom and pivotal about an axis perpendicular to the direction of elongation of said hull, f. said blade protruding downward below the waterline of said hull so as to act as a rudder for steering said boom when said boat is moving through a body of water, and g. means for setting the angular position of said blade about said pivotal axis.

2. A boat according to claim 1, comprising means for acting on the angular position of the blade to steer the boom under variations of the wind to keep the leeway component of the force of the wind on the mainsail at a substantially constant value.

3. A boat according to claim 1, comprising resilient means for acting on the blade to tend to hold the blade in alignment with the boom.

4. A boat according to claim 1, in which said means for setting the blade are adapted to hold the blade in substantially constant pre-set angular position relative to the boat as the boom pivots.

5. A boat according to claim 4, in which said setting means includes a cable secured to a tiller bar of the blade, said cable including an elastically extensible section.

6. A boat according to claim 1, in which said blade is pivotally mounted on a member secured to the boom but having a fixed angular alignment in relation to the boat.

7. A boat according to claim 1, in which said setting means include a flexible cable secured at one end to means for acting on the angular position of the blade, said cable being threadably secured to the mast adjacent to the point of fixture of a trapeze, said trapeze including a harness and a substantially non-extensible filament fixed at one end to the mast and having means for fixing the harness at the other end, and means for adjustably securing the free end of said cable in selected positions relative to the harness.

8. A sailing boat comprising: at least one floating body having a direction of elongation, a longitudinal plane of symmetry, and a waterline, a mast supported by said body and extending in a direction substantially perpendicular to said direction of elongation and lying in a plane parallel to said plane of symmetry, a boom extending from said mast to a free end, said boom being pivotally mounted away from its free end about an axis in said plane of symmetry and substantially parallel to said mast, a mainsail supported on said mast and said boom, said boom attached to and extending the foot of the mainsail, a blade pivotally mounted on the free end of said boom about an axis substantially parallel to said mast, said blade protruding downwardly below said waterline so as to form a rudder for steering said boom, and means for setting the angular position of the blade about its pivoting axis.

* * * * *